US011662164B2

(12) United States Patent
Kastrun

(10) Patent No.: US 11,662,164 B2
(45) Date of Patent: May 30, 2023

(54) MAGAZINE HOLDER FOR A FIREARM

(71) Applicant: GLOCK TECHNOLOGY GMBH, Ferlach (AT)

(72) Inventor: Mario Kastrun, Maria Rain (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 0 days.

(21) Appl. No.: 17/753,392

(22) PCT Filed: Sep. 25, 2020

(86) PCT No.: PCT/EP2020/076858
§ 371 (c)(1),
(2) Date: Mar. 1, 2022

(87) PCT Pub. No.: WO2021/063815
PCT Pub. Date: Apr. 8, 2021

(65) Prior Publication Data

US 2022/0333887 A1 Oct. 20, 2022

(30) Foreign Application Priority Data

Oct. 4, 2019 (EP) ..... 19201444
Nov. 25, 2019 (EP) ..... 19211272

(51) Int. Cl.
*F41A 3/72* (2006.01)
*F41A 9/24* (2006.01)
(Continued)

(52) U.S. Cl.
CPC ..... *F41A 3/72* (2013.01); *F41A 9/24* (2013.01); *F41A 17/38* (2013.01); *F41A 35/06* (2013.01)

(58) Field of Classification Search
CPC ..... F41A 17/38; F41A 35/06
See application file for complete search history.

(56) References Cited

U.S. PATENT DOCUMENTS 4,615,134 A * 10/1986 Beretta ..... F41A 35/06 42/72
5,519,954 A * 5/1996 Garrett ..... F41A 17/38 42/6

(Continued)

FOREIGN PATENT DOCUMENTS

EP 2823249 B1 7/2016
FR 2554916 A1 5/1985
WO 2014056580 A1 4/2014

*Primary Examiner* — Joshua E Freeman
(74) *Attorney, Agent, or Firm* — Raven Patents, LLC; Anton E. Skaugset

(57) ABSTRACT

Magazine holders for firearms, including two actuating elements and a spring, where the first actuating element-has a locking extension for the temporary attachment of a magazine and a first actuating extension, the second actuating element has a second actuating extension, and where the two actuating elements are (operatively) connected to one another such that the locking extension releases the fastening of the magazine counter to the tension of the spring during a release movement onto one of the two actuating elements. Each actuating element is designed as one piece, in that the second actuating element has a bearing extension on an end section facing away form the second actuating extension and connected by a connecting section, and the first actuating element has a substantially shape-complementary bearing opening for receiving the bearing extension in an assembling position.

13 Claims, 12 Drawing Sheets

(51) Int. Cl.
*F41A 35/06* (2006.01)
*F41A 17/38* (2006.01)

(56) References Cited

U.S. PATENT DOCUMENTS

| | | | | |
|---|---|---|---|---|
| 8,713,832 | B2 * | 5/2014 | Troy | F41A 35/06 42/6 |
| 9,541,340 | B2 * | 1/2017 | Fluhr | F41A 35/06 |
| 9,599,419 | B2 | 3/2017 | McGinty | |
| 2006/0123683 | A1 * | 6/2006 | Garrett | F41A 17/38 42/6 |
| 2010/0281736 | A1 * | 11/2010 | Mayberry | F41A 21/481 42/49.01 |
| 2014/0053444 | A1 * | 2/2014 | Garrett | F41A 35/06 42/6 |
| 2016/0069628 | A1 * | 3/2016 | Fluhr | F41A 35/06 42/6 |
| 2018/0149438 | A1 * | 5/2018 | Headrick | F41A 3/72 |
| 2021/0102767 | A1 * | 4/2021 | Kastrun | F41A 35/06 |

* cited by examiner

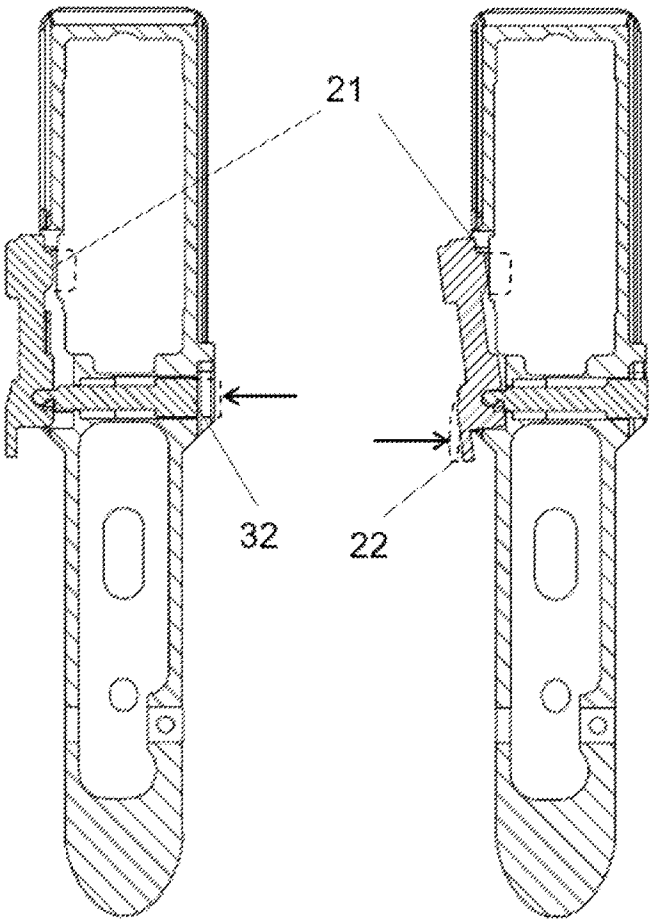
Fig. 4C
Fig. 4B
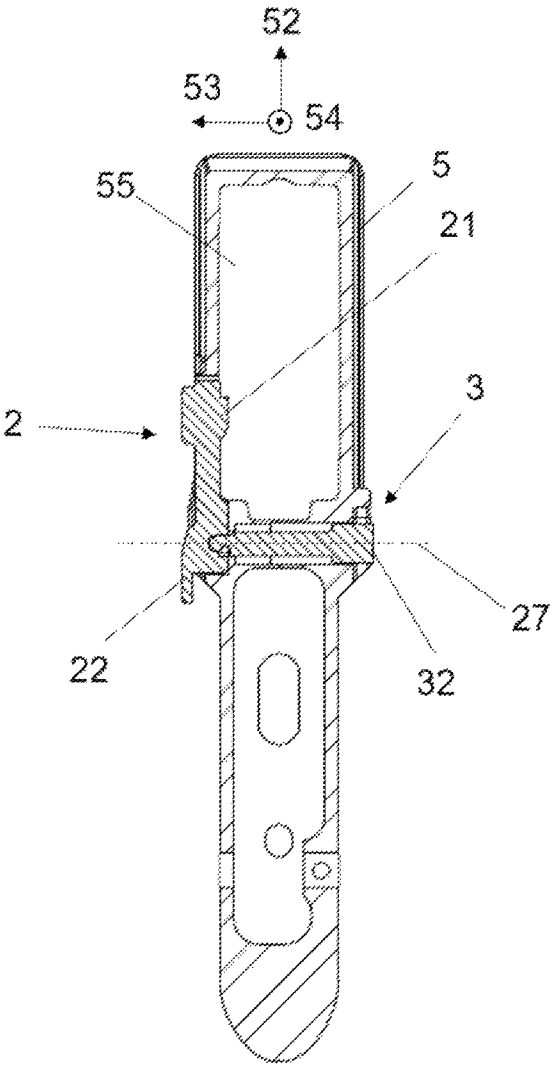
Fig. 4A

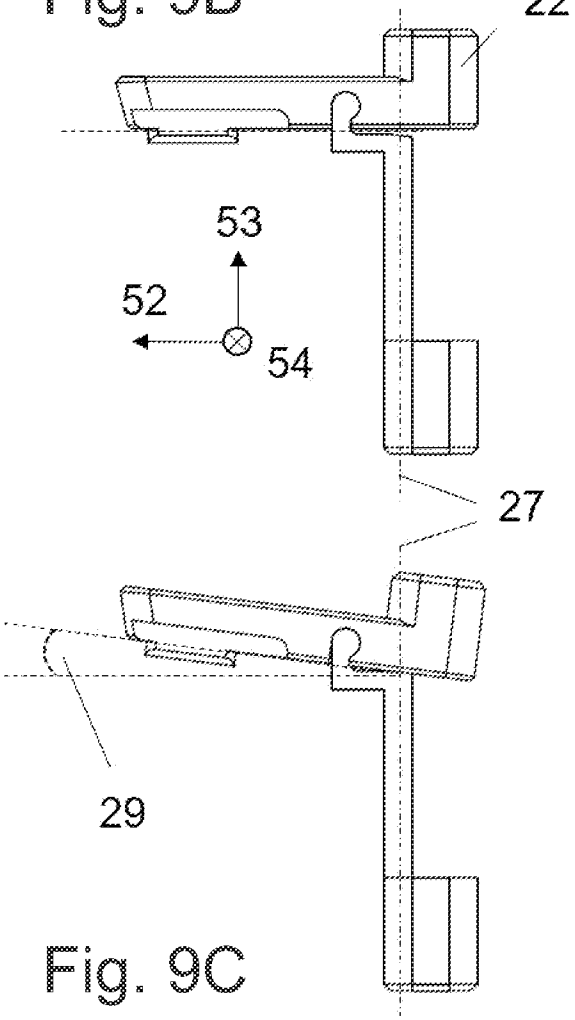
Fig. 9B
Fig. 9C
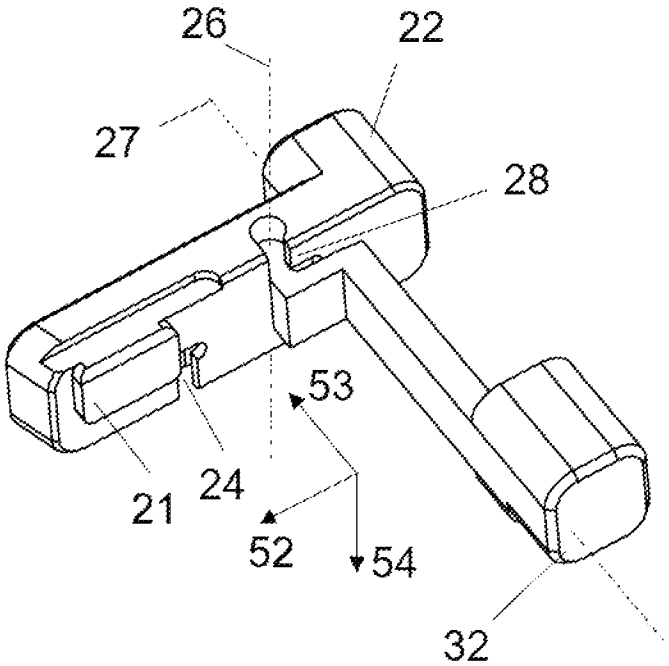
Fig. 9A

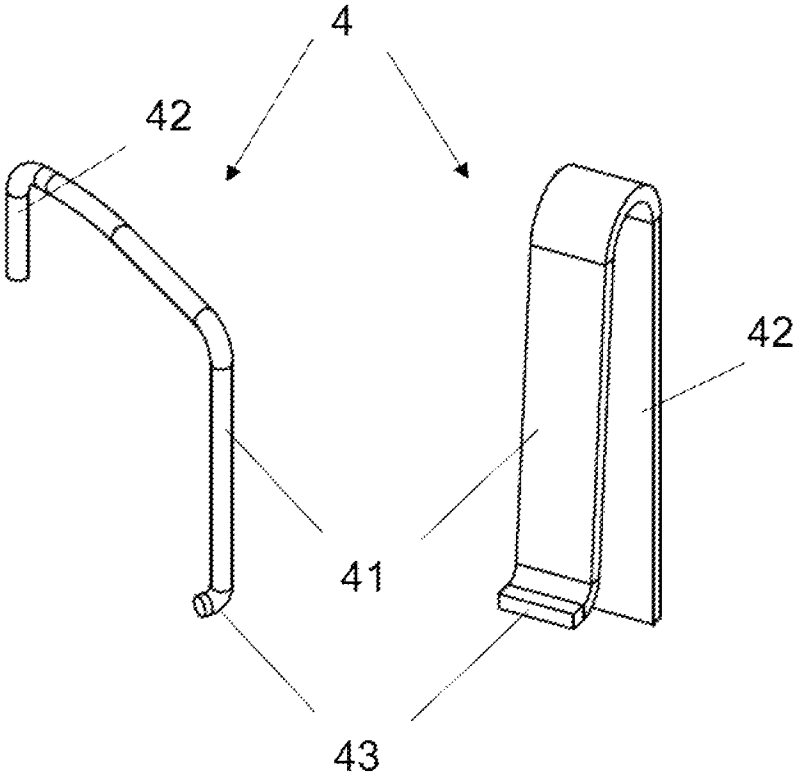
Fig. 13B
Fig. 13A
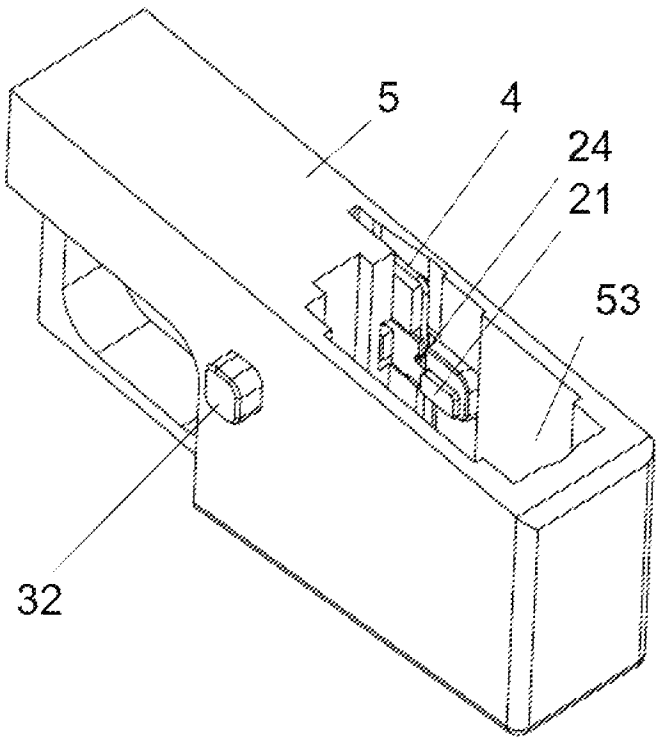
Fig. 12

MAGAZINE HOLDER FOR A FIREARM

TECHNICAL FIELD

The present disclosure relates to firearms, and more particularly relates to a magazine holder for ammunition magazines that have a lateral locking element (recess/extension) on the magazine housing, especially for M4/M16/AR-15 rifles. The present disclosure is not limited to rifles, carbines, etc., but can also apply to pistols. The improvements and their effects/advantages are listed below. In the context of this disclosure a magazine holder is regarded as a synonym for magazine release.

BACKGROUND

When it comes to operating pistols and rifles, the temporary and easily detachable mounting of a magazine in the housing is an immanent topic. Basically, magazines are secured against a slipping out of the housing (the weapon) by a magazine holder which engages in a locking element of the magazine. Such a locking element can be, e.g., a catch, an extension, or preferably a recess (indentation or opening) on the outer shell of the magazine, in which a mating catch, extension, latch, protrusion, finger, or the like of the magazine holder engages/meshes.

A multiplicity of magazines have such locking elements on the side of the magazine housing, when the magazine is viewed in the inserted state relative to the weapon longitudinal axis or to the weapon median plane. Most widely used are magazines that are compatible with rifles on the basis of assault rifles of the AR-15, M16, M4, or similar type. In this case, a recess is most commonly formed on the magazine housing, in which a movable latch of the magazine holder can engage.

Over the years, a large number of magazine holders, which can be actuated on one or both sides, have been developed for such magazines. In addition to the simple and reliable design, a release of the magazine change process to be made possible with both hands was increasingly demanded in the past. A person skilled in the art mostly knows magazine holders that use one or more levers and springs to allow operation on both sides. Representative examples include U.S. Pat. Nos. 8,713,832 B2, 5,519,954 A, 4,615,134 A, 9,599,419 B2, EP 2,823,249 B1, and US 2016/069628 A1. For the jurisdictions in which this is possible, the content of these documents and of the as yet unpublished EP 19201444.7 and EP19211272.0 is, by reference, made part of the content of the disclosure of this application.

In U.S. Pat. No. 8,713,832 B2, which was mentioned at the outset, the magazine is released via a multi-piece, spring-loaded magazine holder, wherein an actuation, as seen in the barrel direction from the right, results in a deflection of the entire magazine holder to the left. In this case, the magazine catch, which is arranged on a holding arm in the inward direction toward the magazine, is deflected so far to the left that a release of the magazine takes place. A release button, which is attached to the holding arm and supported by the housing, also allows a deflection of the magazine catch to the left when actuated.

Similarly, a gearing of the actuation from the left is solved in U.S. Pat. No. 5,519,954 A, wherein the holding arm having the magazine catch, spring-mounted and rotatable about a weapon-mounted bearing journal, is located in a magazine holder housing that, upon actuation, assumes the support on the housing (lower).

U.S. Pat. No. 4,615,134 A also discloses a multi-piece magazine holder having an internal spring. Upon actuation from the left, the magazine can be released in that the release is supported by the housing via a lever, resulting in a lateral deflection of the holding arm due to the rotary connection to the internally arranged holding arm.

Analogously, EP 2 823 249 B1 (corresponding to US 2016/069628 A1) shall be mentioned, which, in a reverse arrangement, has a holding arm having a longitudinal slot in which a handle is arranged for an actuation from the left. The support on the housing is provided via a bulge on the handle, as a result of which the holding arm can be deflected laterally until the magazine is released.

An alternative approach is pursued by U.S. Pat. No. 9,599,419 B2, wherein the magazine holder has a gearing by means of an actuating element acting on both sides. This magazine holder also comprises screws and springs, but an actuation from right to left effects a sophisticated deflection of the actuating element in the vertical direction normal to the barrel axis, resulting in both cases in a coupled deflection of the holding arm or the magazine catch.

Such magazine holders operable on both sides are also widely used for pistols and have a plurality of components and more or less complicated gearing devices for a force transmission (torque transmission) in case of a release movement from the "left" or from the "right". In addition, numerous magazine holders are known from the prior art that require one or even a plurality of springs to return the magazine holder to its original position and/or to pretension the magazine catch. The individual elements require frequent maintenance, the magazine holder becomes error-prone and/or susceptible to contamination with increasing complexity. In addition, the problem of the security against loss for the individual elements is not consistently ensured for the magazine holders described. All known magazine holders additionally require one, occasionally even several tools for installation and/or maintenance. This is particularly problematic under harsh operating conditions.

Therefore, the present disclosure addresses the problem of providing a magazine holder that can be actuated on both sides of the weapon median plane, which overcomes the aforementioned disadvantages of the prior art, and has the lowest possible number of individual components. In addition, the disclosure addresses the problem of providing, at least in one embodiment, a magazine holder that can be assembled without tools and arranged securely against loss in the housing. A further problem addressed by the present disclosure is that the magazine holder requires a preferably even release force from both sides.

SUMMARY

The magazine holder according to the present disclosure has only two actuating elements, which are mutually connected to each other via a bearing extension of the one element and a bearing opening of the other element and separable from each other in an assembly situation by means of vertical displacement, and one spring element.

In the working position, the actuating elements are so far inside the housing due to the biasing of the spring that no vertical displacement of the two actuating elements relative to each other is possible, which is equivalent to an "intrinsic loss-prevention means" and also biases the locking extension in the direction of weapon median plane.

For assembly, the magazine holder is deliberately deflected to the left either in a transverse direction with respect to the weapon median plane to the extent that a vertical displacement of the first actuating element relative to the second actuating element is made possible, or, in another embodiment, the first and the second actuating element can even be connected to each other "outside" of the housing and then introduced in the housing from the "left", wherein the loss prevention likewise occurs due to the arrangement of the spring.

For the embodiments according to the present disclosure, it holds that, when pressure is applied to the second, the right, actuating element, a force is applied to the first, the left, actuating element in such a way that both actuating elements, substantially without changing their relative position to one another, are shifted along a common actuation axis against the force of the spring normally to the weapon median plane in the working situation of the magazine holder in the weapon. As a result, the locking extension provided on the first, the left, actuating element is brought out of the locking element of the magazine.

When the first, the left, actuating element is actuated, the displacement transversely to the weapon median plane, i.e., substantially in the direction of the actuating axis, is prevented by the abovementioned arrangements such that, depending on the design of the spring and/or the second actuating element, a support of the first or second actuating element takes place on the housing. Owing to the small distance of the first actuating extension from the actuating axis, the resulting torque causes the first actuating element to be tilted against the force of the spring about a vertical axis parallel to the weapon median plane, and the locking extension to, in turn, disengage from the locking element of the magazine.

BRIEF DESCRIPTION OF THE DRAWINGS

In the following, the magazine holders of the present disclosure will be explained in more detail using the drawings. In the drawings:

FIGS. 4A, 4B, and 4C are plan views of a section of the magazine holder in working position at rest or in the case of actuation;

FIGS. 9A, 9B, and 9C are perspective views of the two actuating elements of FIG. 8C after assembly at rest and in the limit position;

FIG. 12 is a perspective view of the assembly situation and

FIGS. 13A and 13B show two different springs.

In the Figures of the drawings, "2n" denotes everything relating to the first, left, actuating element, "3n" denotes everything relating to the second, right, actuating element, "4n" denotes everything relating to the spring, and "5n" denotes everything 30 relating to the "rest" of the weapon. The magazine holder as a whole is denoted with 1. Figures "divided" in various ways, such as FIGS. 9A, 9B, and 9C are designated as FIG. 9 without any addition if either a synopsis is referred to or the described situation can be seen in all subfigures.

It is clear to the those skilled in the art that symmetrical embodiments are possible without any problems and can be read silently both in the description of the figures and in the claims.

DETAILED DESCRIPTION

Exemplary embodiments of the present disclosure, which are suitable for use in an AR-15 or M4 rifle, are shown in FIGS. 1 to 6. With knowledge of the solution according to the disclosure, those skilled in the art can also transfer modifications of the illustrated examples to other types of rifles simply and without extensive or complex attempts, as the embodiments of FIGS. 8-13 specifically show. Any other combinations of the technical features of the individual drawings shown and the different embodiments thereof are easily possible for those skilled in the art with knowledge of the present disclosure.

Figure 1:
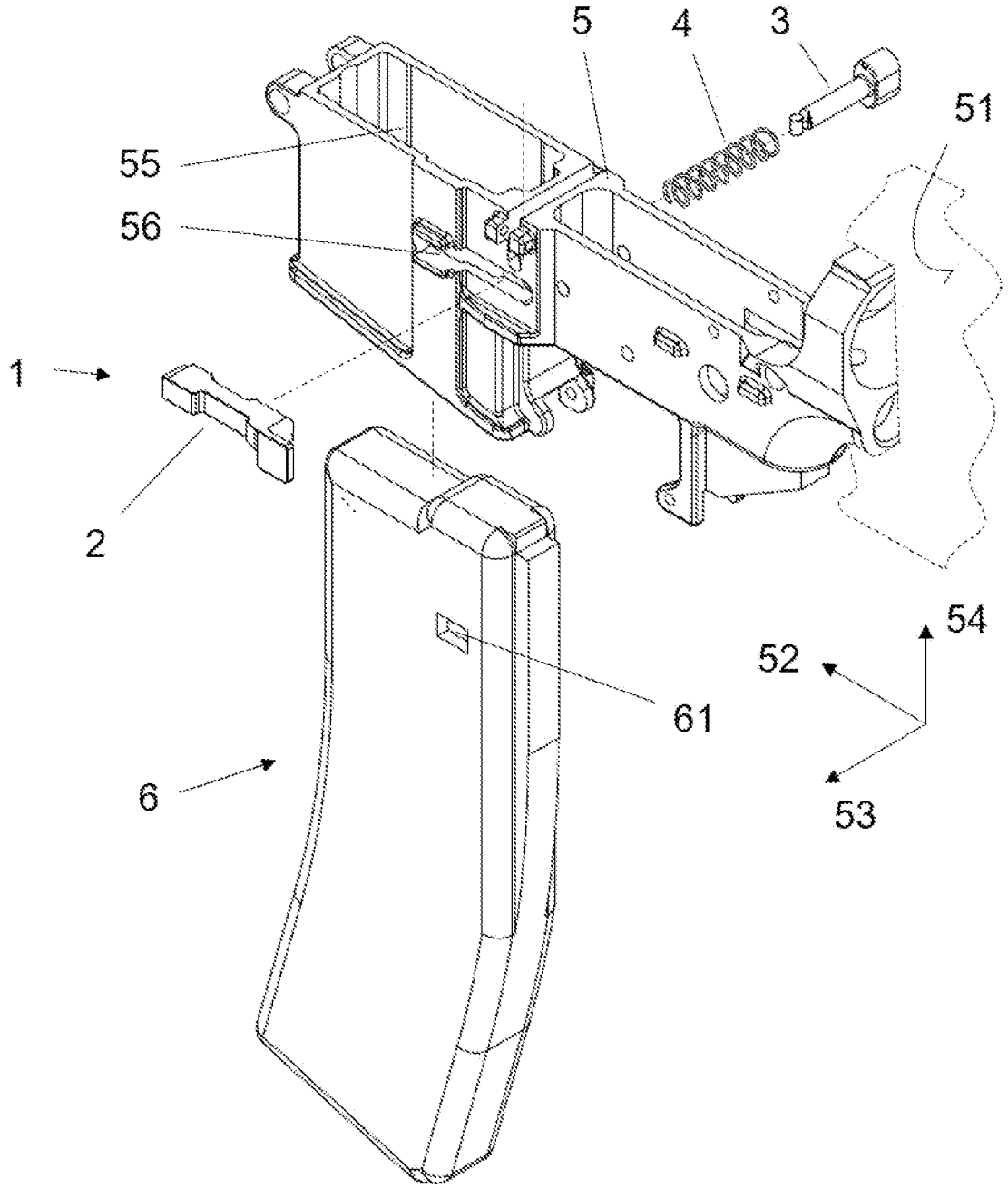
FIG. 1 shows the assembly situation purely schematically in a perspective exploded view.

FIG. 1 is a perspective, schematic view of a weapon housing 5 in the region of the magazine 6. For a better understanding, the weapon median plane 51 and the barrel direction 52 ("forward"), parallel to the bore axis, are also indicated by dashed lines. With the direction "to the left" 53 and the "upward" direction 54, the barrel direction forms a Cartesian coordinate system having an arbitrarily fixed origin because only the directions are important in the present disclosure.

A magazine holder 1 according to the present disclosure, comprising a first, left, actuating element 2, a second, right, actuating element 3 and a spring 4 is shown in the manner of an exploded view. A locking element 61 in the form of a recess of the housing can be seen on the magazine 6. In addition, a lower housing 5 of an AR-15-type rifle is shown schematically in FIG. 1 such that the insertion or assembling position of the individual components can be reconstructed on the basis of the dashed lines. The first actuating element 2 is provided to be received (from the "left", i.e., opposite the illustrated transverse direction on the left 53) in a magazine holder opening 56 provided for this purpose, whereas the second ("right") actuating element 3 is introduced into the weapon housing 5 from the "right" in that it penetrates the spring 4. The installation position or the working position can be seen particularly well in conjunction with FIG. 4. The disassembly/assembly process will be explained separately later.

For all embodiments, the spring 4 according to the present disclosure has a dual function in that it, on the one hand, indirectly keeps the actuating 5 elements 2, 3 in the working position biased and thus indirectly holds the magazine 6 and, on the other hand, ensures the connection of the actuating elements 2, 3 by way of the bias, as a result of which a loss-prevention means of the magazine holder 1 is formed. It is therefore not of primary importance for the embodiments according to the present disclosure which type of spring 4 is used as long as supporting the spring and/or at least one of the actuating elements 2, 3 is achieved on the housing 5 in at least one of the types presented here (or analogously thereto). For this reason, a spring recess 24 is shown on the inside of the first actuating element 2 in the direction of weapon median plane 51 to show the possibility of receiving a spring 4 in a way that corresponds to the description of FIGS. 7-13. In an AR-15/M4-type rifle, a central spring arrangement as shown in FIG. 1 can otherwise be considered to be conventional. In order to avoid a repetition, reference should therefore be made at this point to the following discussion of FIGS. 8-13, and the possibility of combination with a magazine holder 1 that is inserted into the housing 5 from the "right" and from the "left".

Figure 2:
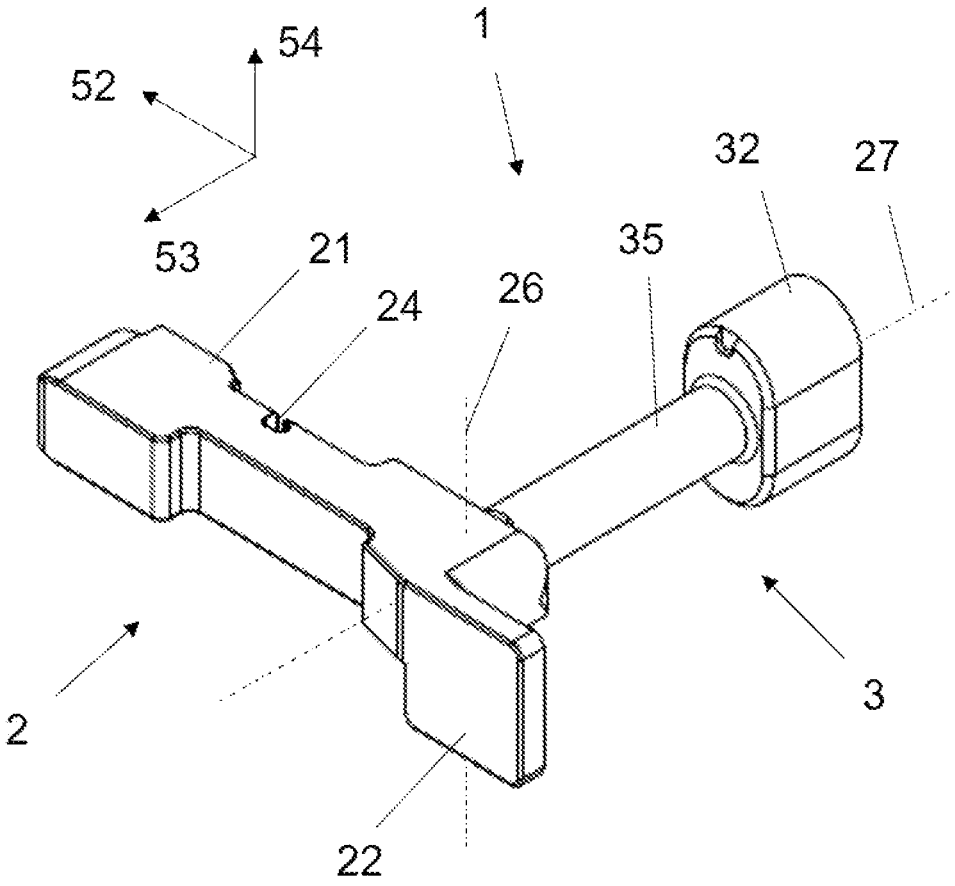
FIG. 2 is a perspective view of the two actuating elements after assembly.

FIG. 2 is an oblique view of the two actuating elements 2, 3 shown in the assembled state, i.e., in working position, without the spring 4 and without any surroundings. In conjunction with FIGS. 3 and 4, it can be seen that the magazine holder 1 can be supported, for example, by a coil spring 4 that is pushed above a connecting section 35 and is, in the working position, supported against the second actuating extension 32 on the inside of the housing 5 after the second actuating element 3 has been received with its bearing extension 33 in the assembling position from the bearing recess 25 of the first actuating element 2. For the sake of clarity, an illustration of the spring 4 has been omitted in FIGS. 4-6.

Figure 3:
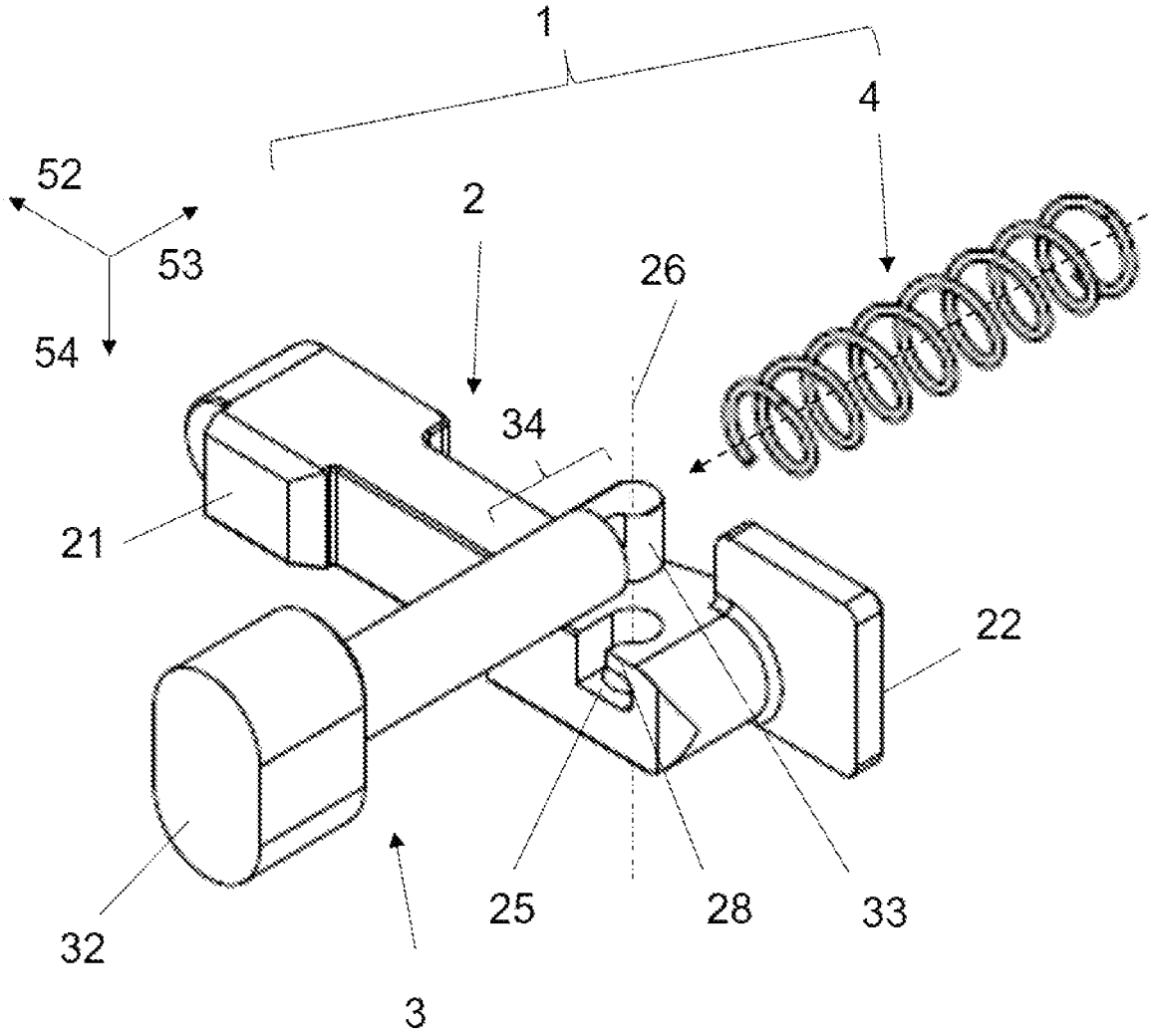
FIG. 3 is a view before assembly corresponding to FIG. 2.

In FIG. 4A, the magazine holder 1 can be seen in the installed state, i.e., the working position, wherein, according to the housing 5 of an AR15-type rifle shown by way of example, the spring 4 of FIG. 3 (a bottom view, as the coordinate system shows) acts upon the housing 5 in the intermediate space of the connecting section 35 and the second actuating extension 32 pushes to the "right". In this way, the connection by means of a bearing extension 33 pulls the first actuating element 2 to the right and thus also biases the locking extension 21 in the direction of weapon median plane 51 (holding position).

In FIG. 4, a release movement from the "right" (FIG. 4B), respectively from the "left" (FIG. 4C), can be seen, wherein, upon actuation from the "right", the first actuating element 2 is deflected substantially along the actuating axis 27 without relative movement with respect to the second actuating element 3. As a result, the locking extension 21 is disengaged from the locking element 61 (FIG. 1) of the magazine 6 and a release is caused. The dashed lines indicate the working position in the rest position corresponding to FIG. 4A.

The first actuating element 2 forms a support region for the second end section 34 in the region of the bearing opening 25 (FIG. 8B) (see FIGS. 3, 5 and 6), against which the end portion 34 lies in the installation or working position. In this way, the arm of the first actuating element 2, on which the locking extension 21 is arranged, can be efficiently prevented from tilting about the "upward" coordinate direction 54 upon actuation "from the right" efficiently.

According to the present disclosure, the bearing opening 25 (FIG. 8B) is designed to be normal to the main longitudinal direction of the first actuating element 2 downward, i.e., opposite the upward coordinate direction 54, and is at least in part open in the direction of the weapon median plane 51 for the passage of the end section 34. This allows very simple, tool-free disassembly/assembly of the magazine holder 1 because the connection between the first and second actuating element 2, 3 takes place by means of simple sliding of the bearing opening 25 across the bearing extension 33, and said bearing opening and bearing extension form a common bearing axis 26. The bearing extension 33 is, at least in one spatial direction, somewhat thickened in relation to the second end section 34 and, in this case, acts as a kind of anchor because the bearing opening 25 allows only the more slender part, i.e., the end section 34, to pass through in the direction of the weapon median plane 51.

The end section 34 can, depending on the type and size of the magazine holder 1 or on the type of the housing 5, be rectilinear (see FIG. 5C), angled or even cranked (see FIGS. 8, 9) before said end section transitions into the connecting section 35. Because the bearing extension 33 serves as a pivot and anchor point, it can be advantageous if it is, depending the application and desired design, barrel-shaped or roller-shaped to serve as a kind of hinge. The distance between the connecting section 35 and the first actuating element 2 can be adjusted in a targeted manner by the design according to the present disclosure and, if appropriate, be modified by those skilled in the art in light of the teaching presented here.

Figure 5C:
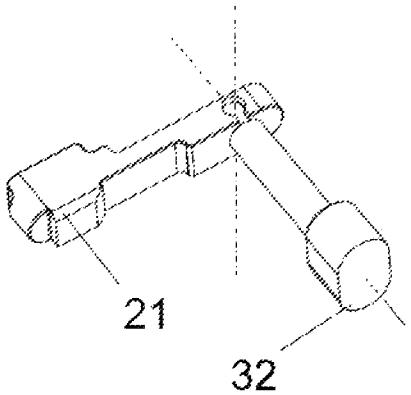
FIGS. 5A, 5B, and 5C are perspective views of various embodiments of the first actuating elements after assembly.
Figure 5B:
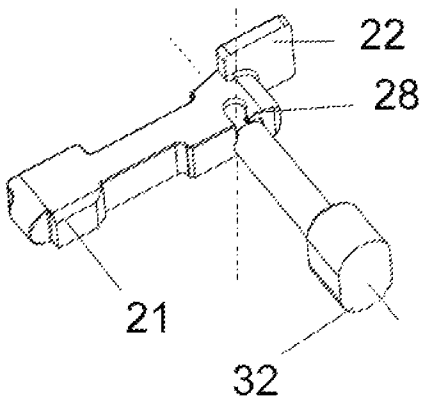
Figure 5A:
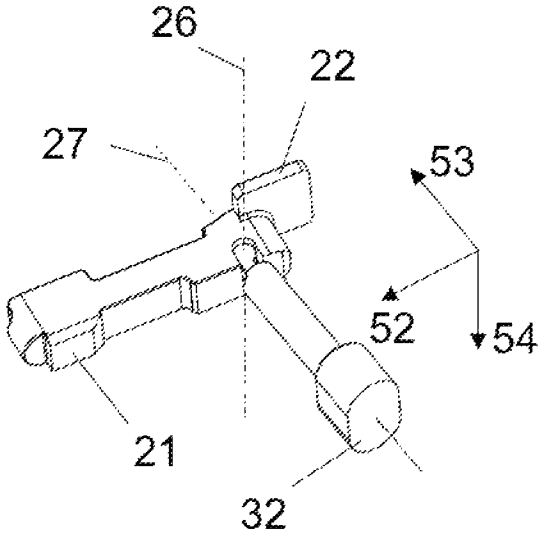

As can be seen from FIG. 5, the magazine holders 1 can be configured differently for different requirements. FIG. 5A and FIG. 5B schematically show magazine holders 1 that allow a slight deflection of the first actuator 2 about an axis parallel to the coordinate direction 54, as is very clear from FIG. 6. In these embodiments, the first actuating element 2 is supported when actuated "from the left" on the inside, i.e., on the side facing the weapon median plane 51, as can be seen in particular when viewing FIGS. 4C and 6C. In this case, the actuating extension 21 is deflected about a working angle 29 and releases the magazine 6.

Due to the installation situation described above, unintentionally displacing the two actuating elements 2, 3 in the working position and upon actuation of the two actuating extensions 22, 32 is not possible because the upper side of the actuating element 2 rests against the inside of the magazine holder opening 56 on the housing 5, as shown by a comparison of FIG. 1 and FIG. 5A. However, it can be advantageous if an additional loss-prevention means 28 is formed on the first actuating element 2 in the region of the bearing opening 25, as can clearly be seen in FIGS. 3, 5B and 6. This additional loss-prevention means 28 is designed as a kind of extension in the barrel direction 52 in such a way that, in the assembly situation, the bearing extension 33 can be freely inserted into the bearing opening 25, but the connected second end section 34 is at least in part concealed in the vertical direction given a slight rotation/tilting of the first actuating element 2 upon actuation of the magazine holder 1 "from the left". This concealment additionally prevents play between the two actuating elements 2, 3 and/or the housing 5.

FIG. 5C shows a particular embodiment of a "rigid" magazine holder 1 that does not allow tilting or rotation of the two actuating elements 2, 3 relative to one another. Such a magazine holder 1 can be used, for example, when actuation "from the left" is expressly not desired or even not allowed. In this case, the connecting section 35 supports the first actuating element 2 over a large area in the region of the bearing opening 25. In this way, only one actuation from the "right" is possible by means of pressure on the second actuating extension.

Figure 6B:
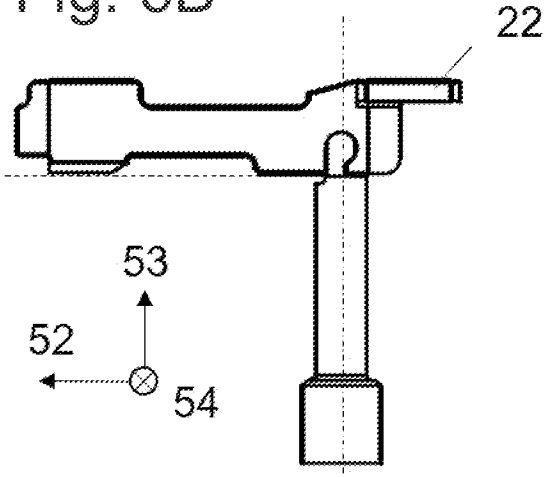
FIGS. 6A, 6B, and 6C are perspective views of the two actuating elements corresponding to FIG. 5B after assembly at rest or in the limit position.
Figure 6C:
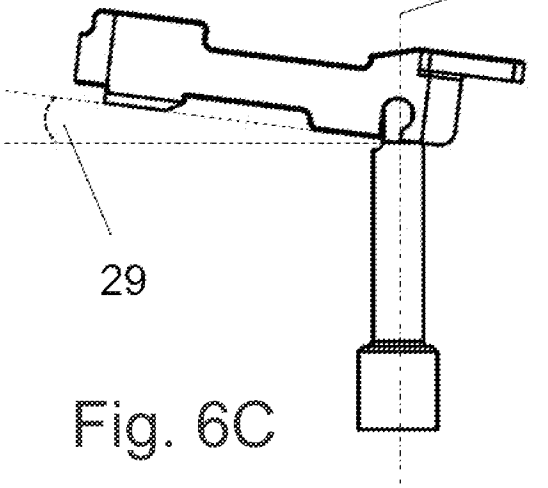
Figure 6A:
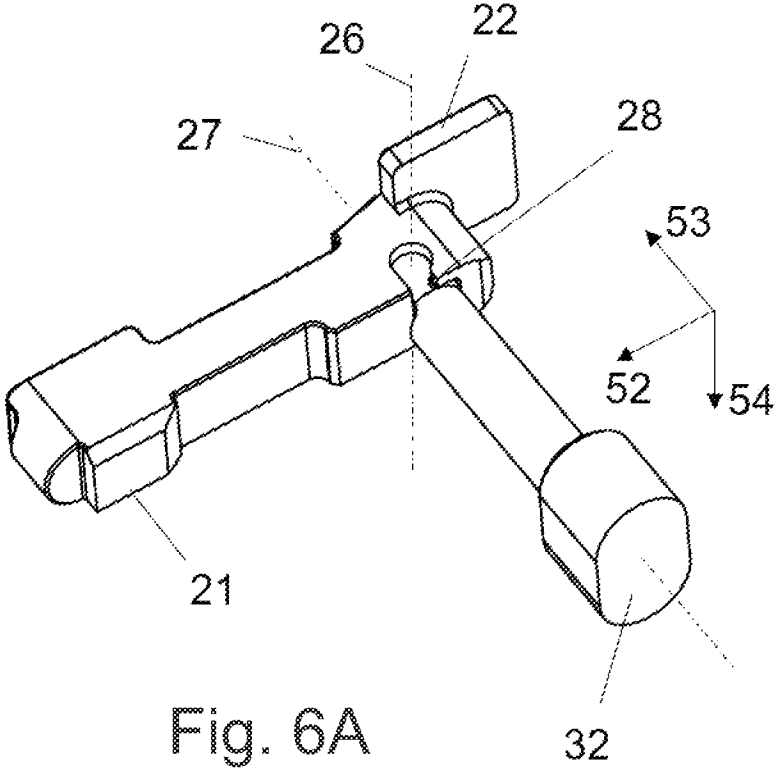

FIG. 6A is a perspective view of a preferred embodiment of the magazine holder 1, which is shown in a plan view in FIGS. 6B and 65C. As previously explained, the deflection or tilting of the first actuating element 2 about the working angle 29 is illustrated in FIG. 6C.

Figure 7:
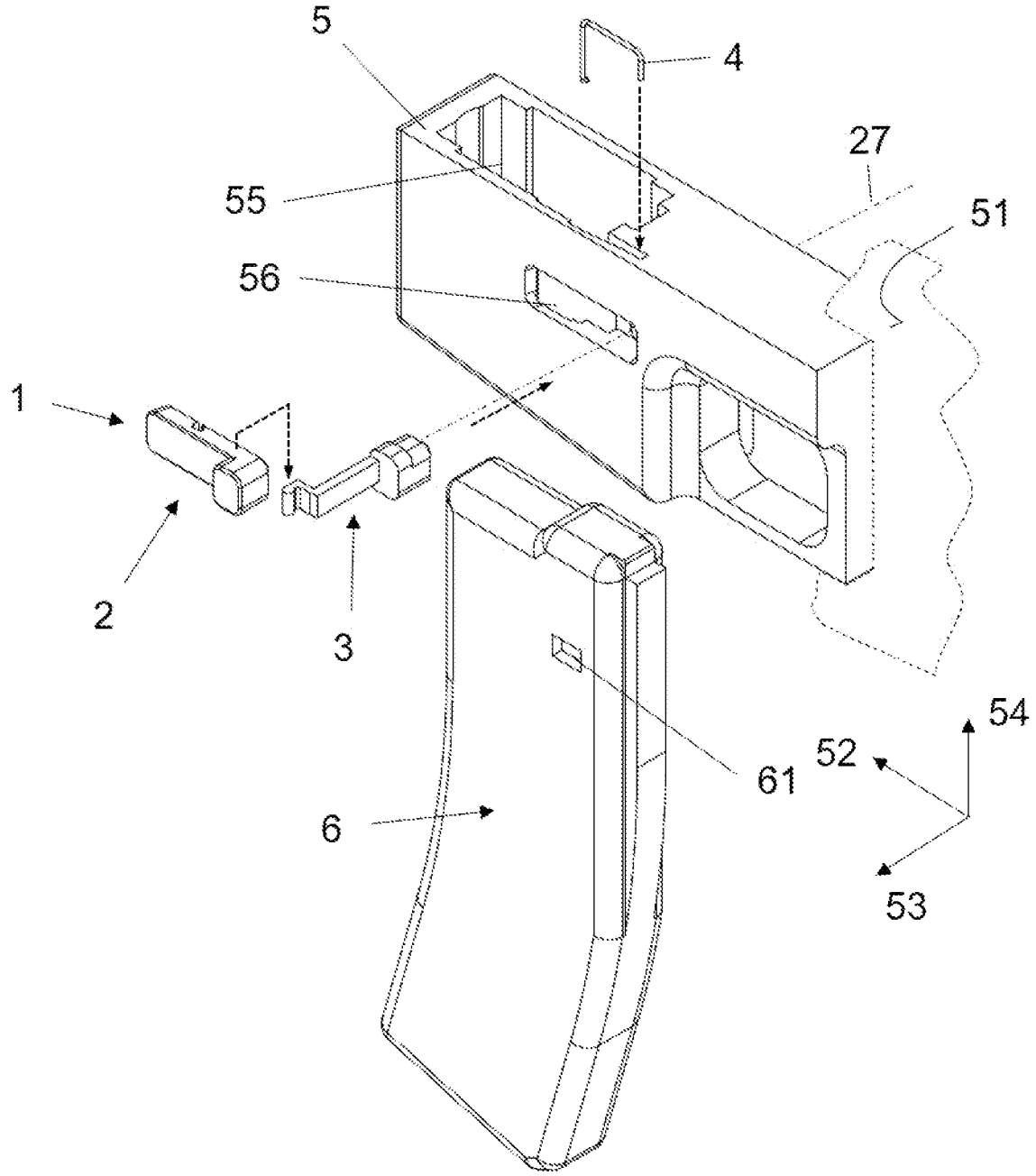
FIG. 7 shows a variant in a view similar to that of FIG. 1.

In FIG. 7, a diagram of the lower housing 5 of a rifle can be seen, which lower housing allows insertion of a magazine holder 1 "from the left" in the direction of the movement arrow indicated by dashed lines. The insertion or mounting position of the individual components can be understood from the exploded view on the basis of the dashed lines and their position in the working position. The first and second actuating element 2, 3 are, in this case, both provided to be received in a magazine holder opening 56 provided for this purpose ("from the left", i.e., opposite the illustrated coordinate direction "to the left" 53). The installation position or the working position can be seen particularly well in conjunction with FIGS. 10 and 12. The disassembly/assembly process will be explained separately later.

Figure 8B:
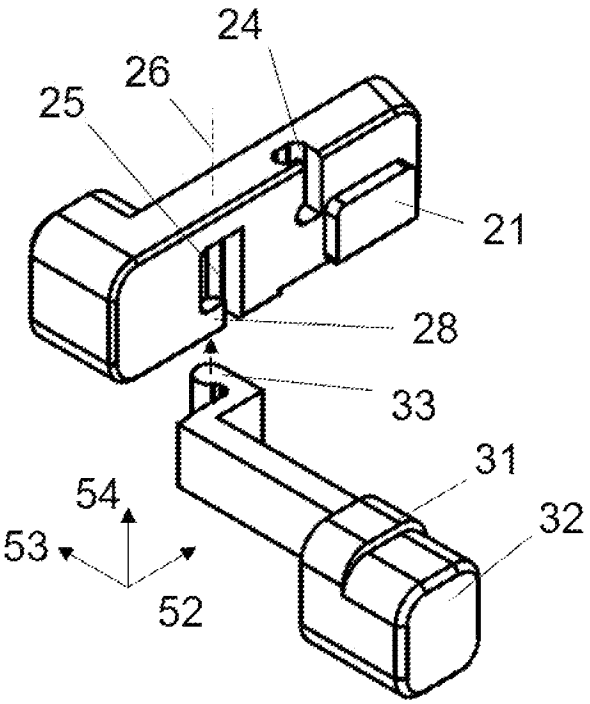
FIGS. 8A and 8B are perspective views of the two actuating elements of a variant before assembly.
Figure 8A:
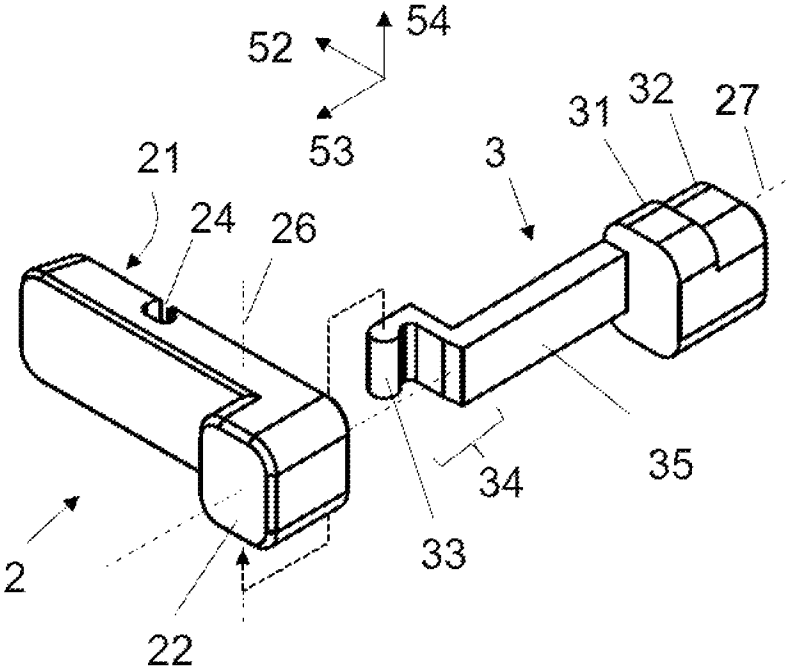

FIG. 8A is a perspective view of the two actuating elements 2, 3 before assembly. FIG. 8B is a representation corresponding to FIG. 8A from a different angle of view (as the respective coordinate system shows), wherein the second actuating element 3 is already aligned for insertion into the first actuating element 2. The first, left, actuating element 2 has a generally elongated-solid shape having a first actuating extension 22, a spring seat 24, and a bearing recess 25 that defines a bearing axis 26. The bearing recess 25 is preferably not continuous in the coordinate direction 54, but is designed for inserting the bearing extension 33, which is why an opening in the direction of weapon median plane 51 is provided over at least a portion of the height in the direction 54, through which opening the second end section 34 passes.

The second, right, actuating element 3 has a generally slim-curved shape having a second actuating extension 32 having a support thickening (=support extension) 31, which are formed on a first end section. At the other end of an elongate connecting section 35, a second end section 34 is provided on which the bearing extension 33 is slightly thickened, at least in a spatial direction, relative to the second end section 34 and, in this case, also acts as a kind anchor or hinge in the bearing recess 25.

When viewing FIG. 9, it can be seen that, in the assembled state, the connecting section 35 is oriented substantially (approximately in direction 53) at right angles to the main longitudinal extension (approximately in direction 52) of the first actuating element 2 so that displacement is facilitated. As in the above description, an additional loss-prevention means can also be formed, as shown particularly well in FIGS. 9A-9C. A repetition of the explanation is omitted with reference to the preceding description. Furthermore, FIG. 9, analogously to FIG. 6, shows a magazine holder whose end section 34 has a cranked (approximately: axis "A"—incline—axis "B" parallel to axis "A") design.

Figure 10B:
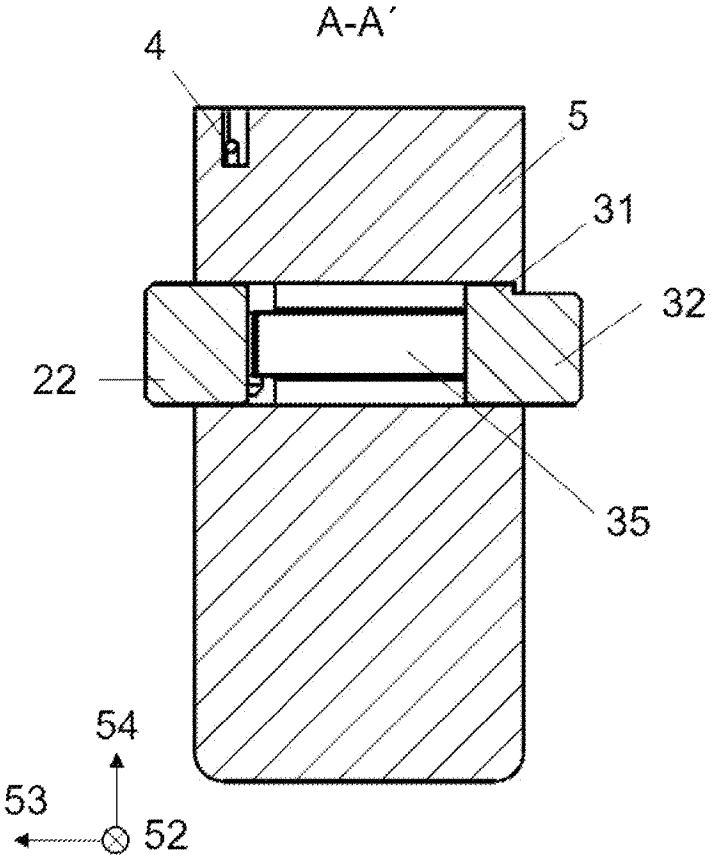
FIGS. 10A and 10B are a plan view and a sectional view, respectively, of the installed idle state.
Figure 10A:
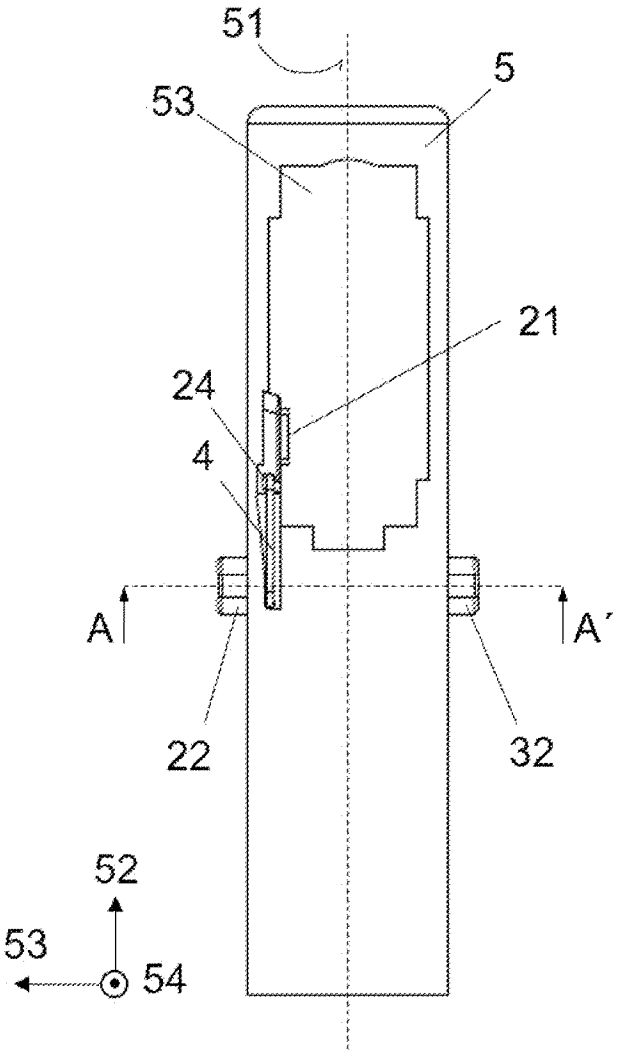

FIG. 10A is a view similar to that of FIG. 4, wherein an additional section Xb-Xb can be seen as FIG. 10B. The aligning position of the two actuating extensions 22, 32 is made clear by the dashed center line as the actuating axis 27. In conjunction with FIG. 8, it can be seen very clearly here that the supporting of the magazine holder 1 in the housing 5 is assumed by the actuating element 3 on the support extension 31. In FIG. 10, it can overall also be seen that the spring 4 is inserted in such a way that one leg or first spring element portion 41 for attachment is formed in the housing 5 and the other leg or second spring element section 42 for engagement and attachment of the first actuating element 2 is formed in the spring recess 24.

In an oblique view from above, FIG. 7 shows the insertion situation or FIG. 12 from the other side of the weapon as FIG. 7, the situation in the installed state without a magazine. The first actuating element 2 is seated in the magazine holder opening 56 (FIG. 7) and is held there by the spring 4. The second actuating element 3 is pushed behind the magazine well 55 approximately normally to the weapon median plane 51 through the weapon housing 5 and protrudes outwardly over its contour. The spring 4 is shown by way of explanation in a perspective view in FIG. 13A. Depending on the orientation, the spring 4 of this embodiment can be considered to be U-shaped or C-shaped, and its shorter end section 42 is inserted into a recess or groove of the housing 5, and its other, longer end section 41, which ends in a twisted securing extension 43, is inserted into the spring recess 24 of the first actuating element 2.

This spring recess 24 is best shown in FIGS. 8A, 8B, and 9A: It is a blind hole-like groove, which is undercut asymmetrically and in its end area, as can be seen particularly clearly in FIG. 8B, and it has both a widening of the opening of the groove and of the undercut such that the securing extension 43 can be threaded but is then held in place while under the spring effect. This is also clearly shown in FIG. 10A and FIG. 12.

FIG. 13B shows a variant of the spring 4 having a slightly wider bearing surface, i.e., essentially a kind of leaf spring. The spring recess 24 would have to be adapted accordingly for this purpose, which does not pose any problems for those skilled in the art with knowledge of the present disclosure. Likewise, those skilled in the art can also select a suitable spring force or spring strength or adjust it so as to achieve the desired object (actuating force). The present instructions allow a person skilled in the art to select the suitable material, its thickness, diameter, etc.

Figure 11A:
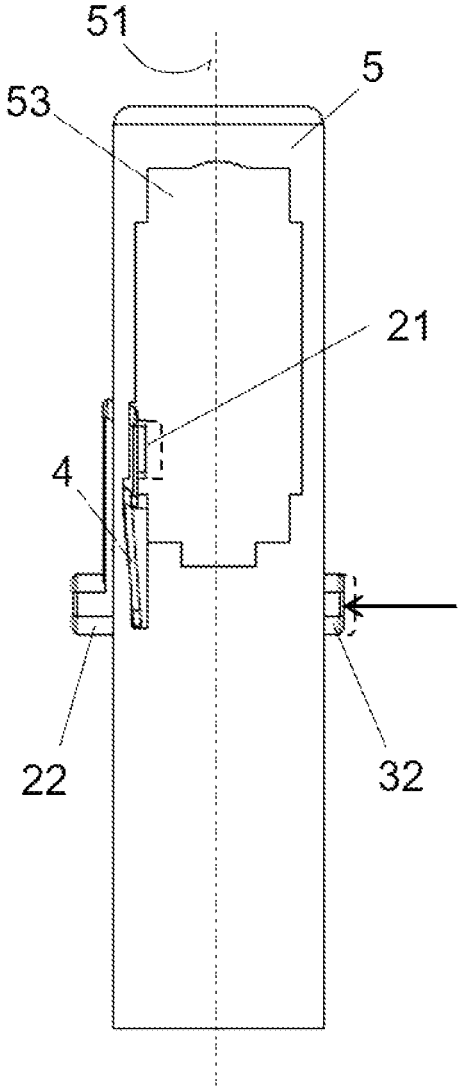
FIGS. 11A and 11B show the variant of FIG. 10A from the left or from the right in the case of actuation.
Figure 11B:
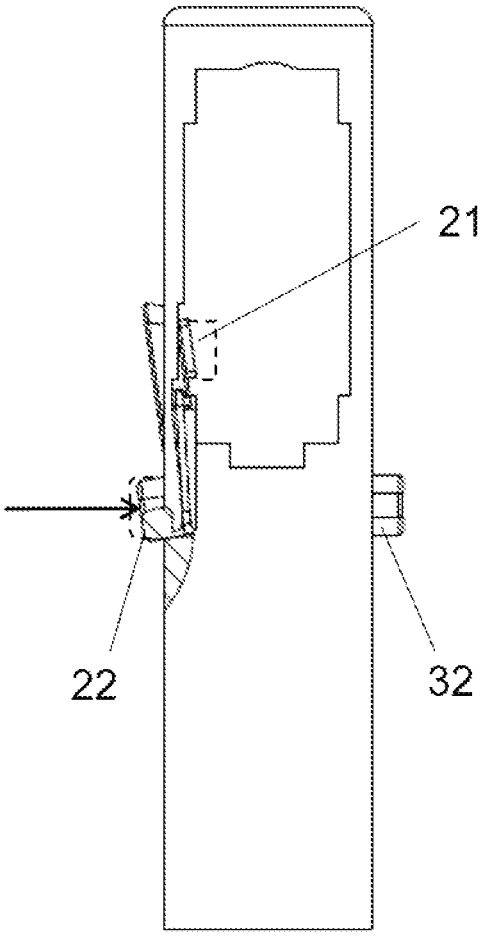

As can now be seen from FIGS. 11A and 11B, in particular in conjunction with FIGS. 7-10 and FIG. 12, the magazine holder 1 is displaced "to the left", i.e., in direction 53, against the bias of the spring 4 when the right actuating extension 32 is pushed. By supporting the first actuating element 2 on the connecting section 35, undesired tilting, apart from a slight play, can be avoided and the locking extension 21 can be disengaged from the magazine 6 substantially without relative movement of the two actuating elements 2, 3.

In FIG. 11B, the actuation of the "left", first actuating extension 22 can be seen, which actuation causes a desired tilting and thus a release of the magazine 6 analogous to the function and description of the preceding examples. In this embodiment, however, the magazine holder 1 is supported in the housing 5 on the inside of the housing 5 in the region in which the support extension 31 is designed so as to protrude in at least one direction relative to the actuating extension 32 (see FIG. 10B). Thus, tilting about the working angle 29 (see FIG. 9) can be achieved.

A preferred further development of the disclosed magazine holders is to make the release force "from the right" and "from the left" during actuation of the magazine holder 1 substantially equal. For this purpose, it is at the discretion of those skilled in the art to, for example, optimize the lever spacing between the vertical tilting axis or axis of rotation of the first actuating element 2 and the locking extension 21. Likewise, the design of the end section 34 and/or the bearing extension 33 and/or the bearing opening 25 can contribute to this effect or cause the effect itself.

The assembly or disassembly can easily be explained for the various embodiments of the magazine holder 1 according to the present disclosure with reference to FIGS. 4 and 7:

For the assembly of two sides, the second actuating element 3 and the spring 4 are inserted "from the right" into the housing 5 and thereby (over-)deflected "inward" in the transverse direction 53, against the force of the spring 4, to such an extent that the bearing extension 33 of the second end section 34 freely protrudes from the housing 5 on the "left" side thereof. Now, the bearing opening 25 of the first actuating element 2 can easily be pushed over the bearing extension 33 from above. Due to the bias of the spring 4, the first actuating element 2 (after release) is pulled so far into the magazine holder opening 56 that unintentional displacement of the actuating elements 2, 3 and thus disassembly can be prevented.

For the assembly of one side, as shown in FIG. 7 in conjunction with FIG. 8 and FIG. 12, the two actuating elements 2, 3 are first connected by means of bearing extension 33 and bearing opening 25 and then introduced into the housing 5 from the "left". Due to the support extension 31 on the second actuating element 3, the magazine holder 1 cannot be "over-deflected to the right". To fix the magazine holder 1 in the housing 5, the spring 4 is finally inserted into the housing 5 with one spring element section 41 and inserted into the spring recess 24 provided for this purpose with the other spring element section 42. In the housing 5, an unintentional rotation from the installation position is no longer possible. Finally, the magazine holder 1 is securely fastened against falling out by means of the spring 4 in the housing 5, and the locking extension 21 is simultaneously pretensioned in the direction of the weapon median plane 51.

In a particular embodiment of the present disclosure, including the previous description of the figures, a further loss-prevention means, accordingly the third, can therefore be formed by a special design of the spring 4 having a securing extension 43.

Another aspect of the present disclosure relates to the possibility of offering the magazine holder 1 as a retrofit kit or as a separately available replacement parts kit. For this reason, in particular in the embodiment according to the description of FIGS. 1-6, the magazine holder 1, which is offered for sale or as a retrofit kit, can contain at least first and second actuating elements (2, 3), as well as a spring (4) according to one of the above embodiments.

Although the present invention has been shown and described with reference to the foregoing operational principles and preferred embodiments, it will be apparent to those skilled in the art that various changes in form and detail may be made without departing from the spirit and scope of the invention. The present invention is intended to embrace all such alternatives, modifications and variances that fall within the scope of the appended claims.

LIST OF REFERENCE NUMERALS

| | | | |
|---|---|---|---|
| 1 | Magazine holder | 4 | Spring element |
| | | 41 | First spring element section |
| 2 | First actuating element (from the "left") | 42 | Second spring element section |
| 21 | Locking extension | 43 | Securing extension |
| 22 | First actuating extension | | |
| 23 | Stop angle | 5 | Weapon housing |
| 24 | Spring recess | 51 | Weapon median plane |
| 25 | Bearing recess | 52 | Barrel direction |
| 26 | Bearing axis | 53 | Transverse direction "left" |
| 27 | Actuating axis | 54 | Upward normal direction |
| 28 | Additional loss-prevention means | 55 | Magazine well |
| 29 | Working angle | 56 | Magazine holder opening |
| 3 | Second actuating element (from the "right") | 6 | Magazine |
| 31 | Support extension | 61 | Locking extension |
| 32 | Second actuating extension | | |
| 33 | Bearing extension | | |
| 34 | Second end section | | |
| 35 | Connecting section | | |

The invention claimed is:

1. A magazine holder for a firearm, comprising:

a first actuating element; the first actuating element being designed as one piece and having a locking extension protruding in a direction of a weapon median plane for temporary attachment of a magazine in the firearm, and a first actuating extension;

a second actuating element; the second actuating element being designed as one piece and having a second actuating extension; and a spring for applying a spring tension;

wherein the second actuating element includes a bearing extension on an end section facing away from the second actuating extension and connected by a connecting section, whereby the bearing extension is of thickened design with respect to the end section in at least one spatial direction;

the first actuating element has a substantially shape-complementary bearing opening for receiving the bearing extension in an assembling position; and the two actuating elements are operatively connected to one another such that a release movement of one of the two actuating elements counter to the tension of the spring results in the locking extension releases a temporary attachment of the magazine in the firearm.

2. The magazine holder of claim 1, wherein the bearing opening is configured so as to be normal to a downward main longitudinal direction of the first actuating element, and is configured to be at least in part open in the direction of the weapon median plane for the passage of the end section of the second actuating element.

3. The magazine holder of claim 1, wherein the bearing recess is configured such that a common bearing axis is formed with the bearing extension when in a working position.

4. The magazine holder of claim 1, further comprising an additional loss-prevention element that at least in part conceals the bearing opening in the direction of the weapon median plane that is formed on the first actuating element.

5. The magazine holder of claim 1, wherein the first actuating element includes a spring recess for receiving a first end section of the spring.

6. The magazine holder of claim 5, wherein the firearm includes a weapon housing, the spring includes a first end section that is configured to be received in the spring recess, and a second end section that is configured to be received in the weapon housing.

7. The magazine holder of claim 6, wherein the spring at the first end section is associated with the weapon housing, has a securing extension that protrudes normally to a downward main longitudinal extension of the first end section, and that is configured to be inserted into an undercut or a shape-complementary recess of the spring recess.

8. The magazine holder of claim 1, wherein the firearm includes a weapon housing, and the second actuating element includes a support extension adjacent to the second actuating extension, wherein at least a portion of a circumference of the support extension protrudes beyond the actuating extension so as to support the magazine holder in the weapon housing.

9. The magazine holder of claim 1, wherein the firearm includes a weapon housing, and the spring for applying the spring tension is arranged between the weapon housing and the second actuating extension.

10. The magazine holder of claim 1, wherein the end section is configured to be straight, angled and/or cranked with respect to the connecting section.

11. The magazine holder of claim 1, wherein the bearing extension has a barrel-shaped or roller-shaped design.

12. A replacement parts kit comprising a magazine holder for a firearm;

wherein the magazine holder for the firearm includes:

a first actuating element; the first actuating element being designed as one piece and having a locking extension protruding in a direction of a weapon median plane for temporary attachment of a magazine in the firearm, and a first actuating extension;

a second actuating element; the second actuating element being designed as one piece and having a second actuating extension; and a spring for applying a spring tension;

wherein the second actuating element includes a bearing extension on an end section facing away from the second actuating extension and connected by a connecting section, whereby the bearing extension is of thickened design with respect to the end section in at least one spatial direction;

the first actuating element has a substantially shape-complementary bearing opening for receiving the bearing extension in an assembling position; and the two actuating elements are operatively connected to one another such that a release movement of one of the two actuating elements counter to a tension of the spring results in the locking extension releasing the temporary attachment of the magazine.

13. A firearm, comprising a magazine holder;

wherein the magazine holder includes:

a first actuating element; the first actuating element being designed as one piece and having a locking extension protruding in a direction of a weapon median plane for temporary attachment of a magazine in the firearm, and a first actuating extension;

a second actuating element; the second actuating element being designed as one piece and having a second actuating extension; and a spring for applying a spring tension;

wherein the second actuating element includes a bearing extension on an end section facing away from the second actuating extension and connected by a connecting section, whereby the bearing extension is of thickened design with respect to the end section in at least one spatial direction;

the first actuating element has a substantially shape-complementary bearing opening for receiving the bearing extension in an assembling position; and the two actuating elements are operatively connected to one another such that a release movement of one of the two actuating elements counter to a tension of the spring results in the locking extension releasing the temporary attachment of the magazine.

* * * * *